United States Patent [19]

Lusi

[11] 4,277,090

[45] Jul. 7, 1981

[54] MUSIC SCORING AND MUSICAL STAFFS

[76] Inventor: Domenico F. Lusi, 427 Cedarville St., Pittsburgh, Pa. 15224

[21] Appl. No.: 963,096

[22] Filed: Nov. 22, 1978

Related U.S. Application Data

[63] Continuation of Ser. No. 643,710, Dec. 23, 1975, abandoned, which is a continuation of Ser. No. 137,126, Apr. 26, 1971, abandoned.

[51] Int. Cl.[3] ..... G10G 1/00

[52] U.S. Cl. ..... 283/47

[58] Field of Search ..... 283/47

[56] References Cited

U.S. PATENT DOCUMENTS

| | | | |
|---|---|---|---|
| Re. 13,016 | 8/1909 | Smith | 283/47 |
| 225,596 | 3/1880 | Hastings | 283/47 |
| 828,020 | 8/1906 | Davis | 283/47 |
| 1,004,215 | 9/1911 | Stringfield | 283/47 |

FOREIGN PATENT DOCUMENTS

| | | | |
|---|---|---|---|
| 395326 | 10/1931 | United Kingdom | 283/47 |

*Primary Examiner*—John McQuade

[57] ABSTRACT

A composite musical staff of at least two sets of five equally spaced lines each, the two sets of lines forming a composite treble-base clef staff being separated by one line and two spaces and the two sets of lines forming the composite bass and composite treble clef staffs being separated by two lines and three spaces and the composite cleff staff of multiple treble and bass notes having the sets of lines forming the treble notes separated from the sets of lines forming the base notes by a single line and two spaces and the sets of lines in each of the treble and bass being separated by two lines and three spaces, a distance equivalent to the minimum number of lines and spaces necessary to provide continuity of note identification on all treble clef staffs and on all bass clef staffs and between treble and bass clef staffs.

8 Claims, 8 Drawing Figures

MUSIC SCORING AND MUSICAL STAFFS

This application is a continuation of my copending application Ser. No. 643,710, filed Dec. 23, 1975 now abandoned, which in turn was a continuation of my then copending application Ser. No. 137,126 filed Apr. 26, 1971, now abandoned.

This invention relates to music scoring and musical staffs and particularly to new methods of scoring and to new musical staffs which markedly simplify the orchestration of music.

Music is normally written or scored on a musical staff of five lines with one of seven clefs (alto, tenor, soprano, bass, treble, etc.). The treble clefs normally encompass the middle range notes E, F, G, A, B, C, D, E and F on or within the staff. The bass or F clef encompassing the notes G, A, B, C, D, E, F, G and A on or within the staff. The other clefs are scored by moving the position of the note known as middle C on the staff and the clef is then known as soprano, alto, tenor, etc., depending upon the position of the clef sign on the staff. With this system of scoring music it is necessary to transpose the notes as scored for many orchestra instruments and still use multiple ledger lines above and below the staff. These alternatives are a source of great inconveniences and confusion. As a result There have been many proposals advanced for simplifying the problem of transposition but no real attempt to get at the real seat of the problem which is in the scoring of the music. For example, in music transposition, it is necessary to transpose from one given key to another for a particular instrument, particularly the clarinet, cornet, trombone, French horn, bassoon, and many others. Many devices have been provided for simplifying the problems of transposition. Examples of this are the music transposing scale computer of Capps (U.S. Pat. No. 2,925,750), the transposing device of Mears (U.S. Pat. No. 1,431,972), and that of Barnes (U.S. Pat. No. 2,689,500). There have been attempts made to provide systems of altered music notation for the purpose of simplifying teaching such as the systems disclosed in the following listed United States patents:

| | |
|---|---|
| Faunt | 1,539,308 |
| Petersen | 2,232,264 |
| Maffei | 2,271,772 |
| Wright | 104,393 |
| Clime | 52,534 |
| Glenn | 3,331,271 |
| Cramer | 152,726 |

None of the foregoing patents, however, goes to the real root of the problem which lies in the inadequacy of the present system of scoring using one five line staff.

My invention cuts down the number of clefs from seven to three and provides continuity of note identification on all treble clef staffs and on all bass clef staffs and between treble and bass clef staffs.

I have invented a new musical scoring method and staff system which eliminates the need for transposing of notes and the likelihood of confusion which results from the need to use many ledger lines. My invention provides a system which reduces all orchestrated scores to the relative simplicity of piano or organ music and in which the student studying those instruments which are generally known as the transposing instruments will be able to visualize and hear his notes as they really are relative to the normal C instruments such as the piano, violin, oboe, etc., and the human voice from the very beginning of his studies rather than being confused by the apparently unrelated nature of his musical notations to those of other instruments. In addition to this, my invention will also save years of time for these instrumental students and especially for those wishing to become conductors, arrangers and composers.

Preferably I provide a new staff for middle range instruments made up of two sets of five equally spaced lines each, the two sets of lines spaced apart a distance equal to that between three lines of either of said sets of equally spaced lines and a new staff for high or low range instruments made up of two sets of five equally spaced lines each, the two sets of lines spaced apart a distance equal to that between four lines of either of said sets of equally spaced lines. The new staff for middle range instruments may be combined with either or both the staff for low range instruments and the staff for high range instruments using one set of five lines of the middle range staff as one set of lines for the low range staff and the other as one set of lines for the high range staff to provide a staff having four spaced apart sets of five lines each, the two intermediate sets of five lines spaced apart a distance equal to that between three lines and the two extreme sets each being spaced from the two intermediate sets of lines by a distance equal to the distance between four lines of the sets of lines. The point midway between the two sets of lines making up the middle range staff is equivalent to the note known as "middle C" on the piano and the staff might be designated the "Middle C Clef" staff. The two notes on either side of this are, of course, B and D. In the case of the low instruments the staff might be called the double bass clef. The notes between the two sets of lines would be B, D and F on the open spaces and C and E on the ledger lines which would normally ball therebetween. In the case of high instruments the new staff might be called the double treble clef. The notes between the two sets of lines would be G, B and D on the open spaces and A and C on the ledger lines which would normally fall therebetween.

In the foregoing specification, I have set out certain objects, purposes and advantages of my invention. Other objects, purposes and advantages will be apparent from a consideration of the following description and the accompanying drawings in which.

Figure 1:
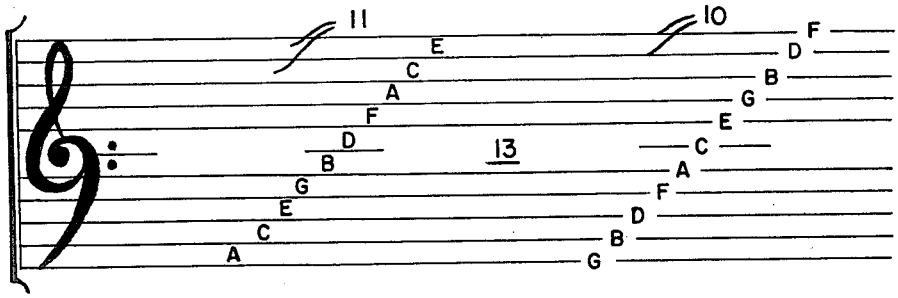
FIG. 1 is an illustration of the new middle range instrument staff according to my invention.

Referring to the drawings I have illustrated in FIG. 1 a new middle range staff according to my invention. I have shown the position of the several notes on both the lines 10 and the spaces 11 of the staff. The staff is made up of two sets of five equally spaced lines 10, the two sets separated by a space 13 equal to the distance between three lines 10 and of the two spaced sets.

Figure 2:
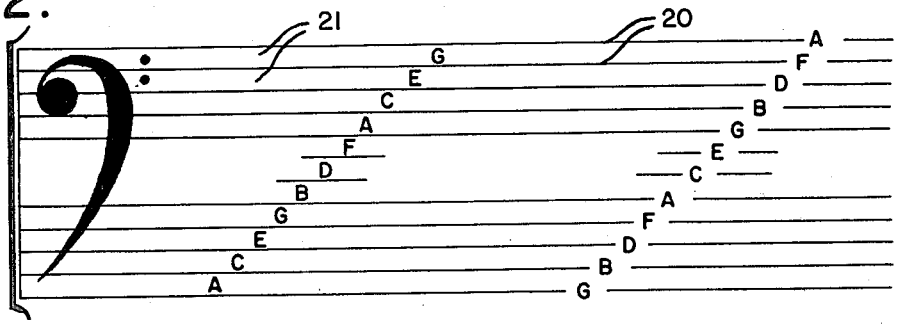
FIG. 2 is an illustration of the new double bass clef staff for low range instruments according to my invention.

In FIG. 2 I have illustrated the low range staff according to my invention with the position of the several notes indicated thereon on both the lines 20 and the spaces 21 of the staff. Here the staff is made up of two sets of five equally spaced apart lines 20, the two sets of lines being separated by a space equal to that between four lines of the two sets of lines.

Figure 3:
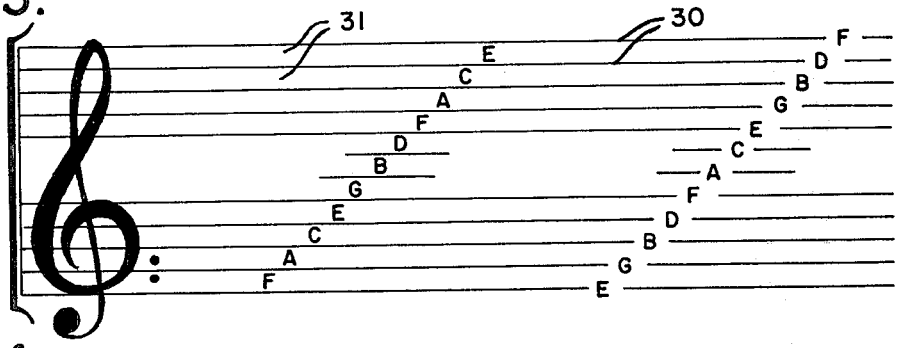
FIG. 3 is an illustration of the new double treble clef staff for high range instruments according to my invention.

In FIG. 3, I have illustrated a high range staff according to my invention with the positions of the several notes indicated thereon on both the lines 30 and spaces 31 of the staff. Here the staff is made up as in FIG. 2 with two sets of five equally spaced apart lines 30, the two sets of lines being separated by a space equal to that between four lines of the two sets of lines.

Figure 4:
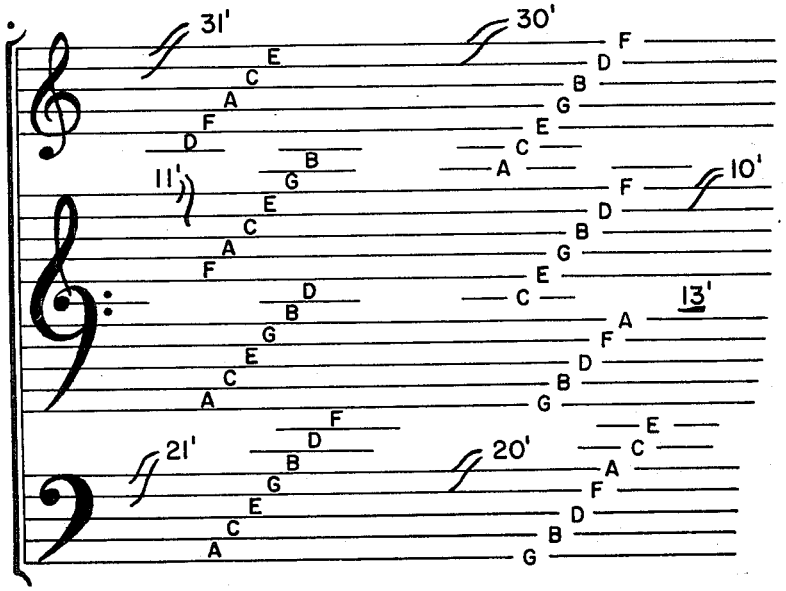
FIG. 4 is an illustration of the combined staff using the new middle range staff and each of the high and low range staffs of my invention.

In FIG. 4 I have illustrated a combination staff based upon the middle range staff of FIG. 1 and one half of each of the low and high range staffs of FIGS. 2 and 3 respectively. This Figure carries identifying numerals corresponding to the several Figures from which they are derived but with the addition of a prime (') sign.

Figure 5:
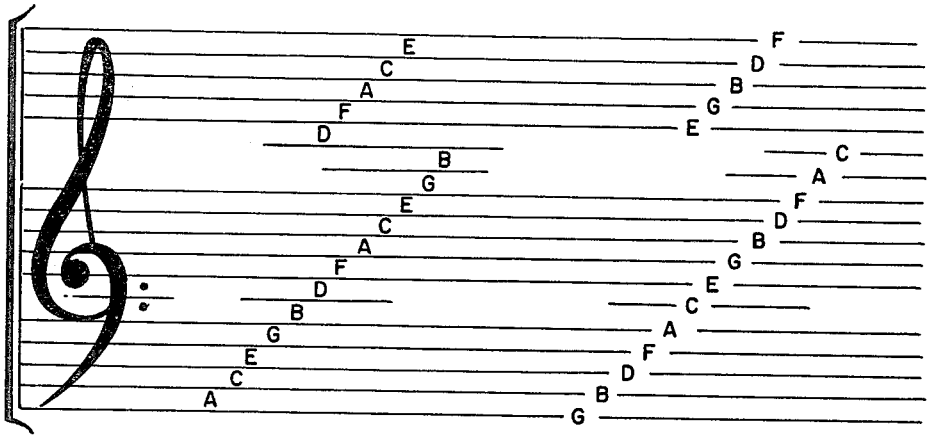
FIG. 5 is an illustration of the combined staff using the middle range staff and the high range staff of my invention.

In FIG. 5 I have illustrated a combination staff based upon the middle range staff of FIG. 1 and one half of the high range staff of FIG. 3.

Figure 6:
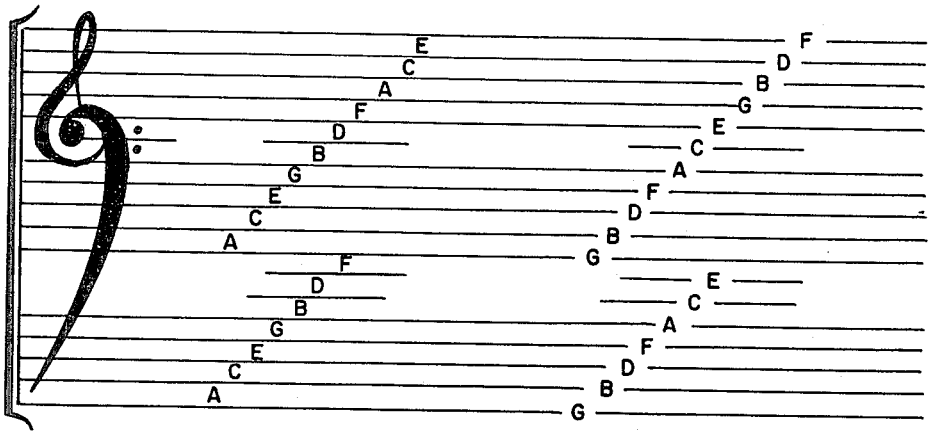
FIG. 6 is an illustration of the combined staff using the middle range staff and the low range staff of my invention.

In FIG. 6 I have illustrated a combination staff based upon the middle range staff of FIG. 1 and one half of the low range staff of FIG. 2.

Figure 7:
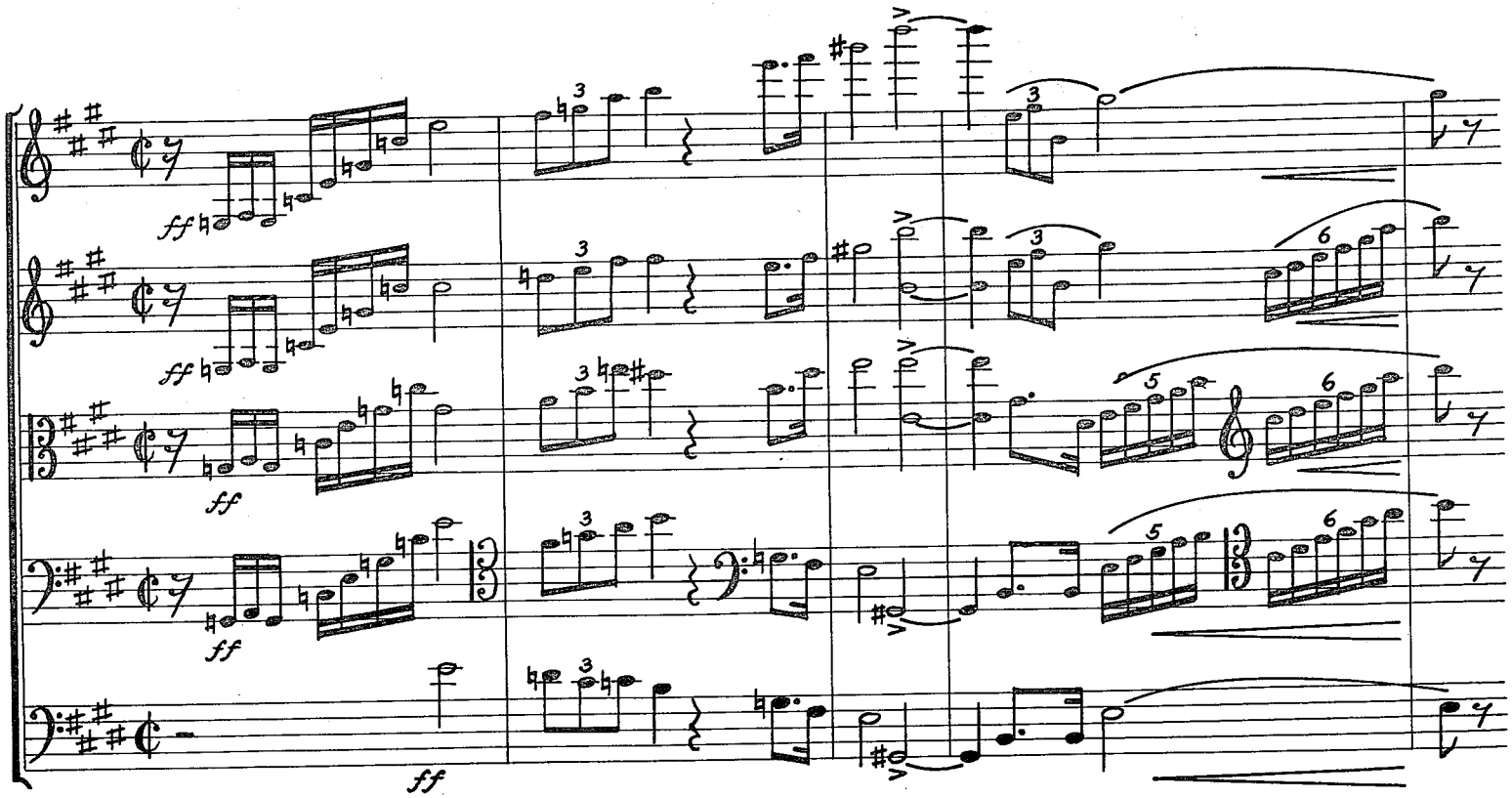
FIG. 7 is an illustration of an orchestration of a portion of music according to present day techniques.

In FIG. 7 I have illustrated the first four and a fraction bars of the orchestration for "Don Juan" by Richard Strauss as written in conventional music scoring.

Figure 8:
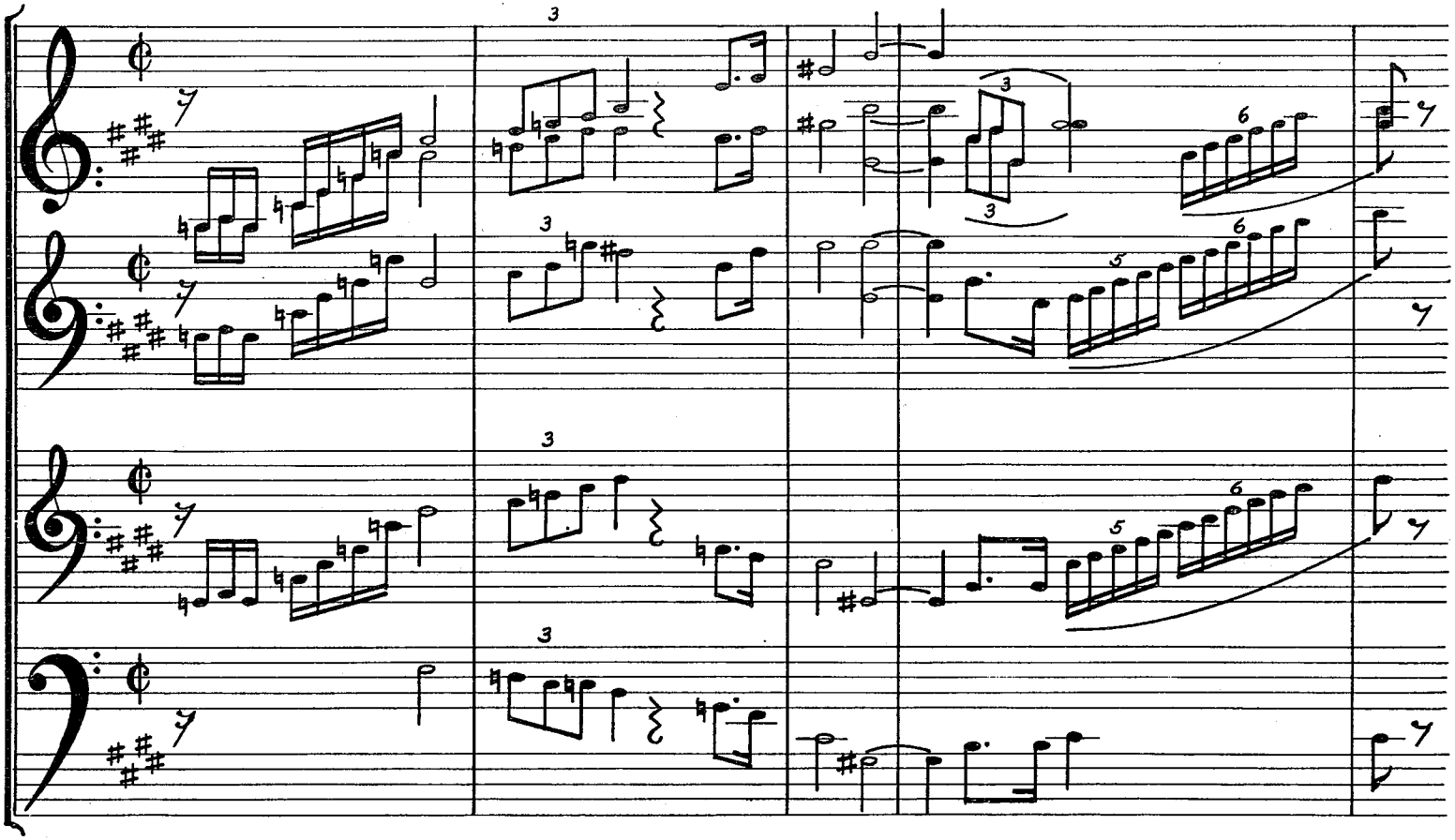
FIG. 8 is an illustration of the orchestration of the same music as FIG. 7 using the new staffs of my invention.

In FIG. 8 I have illustrated the same first four and a fraction bars of "Don Juan" scored according to my invention.

It is apparent at once to those skilled in the musical arts that in the same space required for one ordinary musical staff and its notes above and below the staff with ledger lines, I have a musical staff that will encompass without need for transposing the extension of the tenor and alto voice and the following transposing instruments among others: bassoon, cello, viole, trombone, baritone, horn in F, horn in $E^b$, tenor sax, bass clarinet, clarinet contralto in $E^b$, English horn, bass trumpet in $E^b$, guitar, etc.

In the foregoing specification I have set out certain preferred practices and embodiments of my invention, however, it will be obvious that this invention may be otherwise embodied within the scope of the following claims.

I claim:

1. A composite musical staff for receiving musical notes comprising at least two sets of five equally spaced lines each, said at least two sets of five equally spaced lines forming at least one of a composite bass and treble clef staff, a composite bass clef staff, a composite treble clef staff, a composite multiple treble clef and multiple bass clef staff, a composite multiple treble clef and single bass clef staff, and a composite single treble clef and multiple bass clef staff, the at least two sets of five equally spaced lines forming said composite treble and bass clef staff being separated by one line and two spaces, the at least two sets of five equally spaced lines forming the composite bass clef staff being separated by two lines and three spaces, the at least two sets of five equally spaced lines forming the composite treble clef staff being separated by two lines and three spaces, the composite multiple bass clef and multiple treble clef staff having at least two sets of five equally spaced lines separated by two lines and three spaces forming the multiple treble clef portion of the staff separated from at least two sets of five equally spaced lines forming the multiple bass clef portion of the staff by one line and two spaces and the at least two sets of five equally spaced lines forming the multiple bass clef portion of the staff being separated by two lines and three spaces, the composite multiple treble clef and single bass clef staff having at least two sets of five equally spaced lines forming the multiple treble clef portion of the staff separated from a set of lines forming the bass clef portion of the staff by one line and two spaces and the at least two sets of lines forming the treble clef portion being separated by two lines and three spaces, and the single treble clef and multiple bass clef staff having a set of five equally spaced lines forming the treble clef portion of the staff separated from at least two sets of five equally spaced lines forming the multiple bass clef portion of the staff by one line and two spaces and the at least two sets of lines forming the bass clef portion of the staff being separated from each other by two lines and three spaces.

2. A composite bass and treble clef musical staff as claimed in claim 1 for middle range instruments having one set of five equally spaced lines forming a treble portion of the clef staff and one set of five equally spaced lines forming a bass portion of the clef staff wherein the two sets of lines are spaced apart by a single line and two spaces.

3. A composite musical staff as claimed in claim 2 wherein the notes applied between the bass clef portions and the treble clef portions of the composite bass and treble clef staff in ascending order from the bass lines to the treble lines are B, C and D.

4. A composite bass clef musical staff as claimed in claim 1 for low range instruments having at least two sets of five equally spaced lines forming a composite bass clef staff adapted for receiving bass clef notes wherein the sets of lines are spaced apart by two lines and three spaces.

5. A composite musical staff as claimed in claim 4 wherein the notes applied between the sets of equally spaced lines forming the composite bass clef staff in ascending order are B, C, D, E and F.

6. A composite treble clef musical staff as claimed in claim 1 for high range instruments having at least two sets of five equally spaced lines forming a composite treble clef staff adapted for receiving treble clef notes wherein the sets of lines are spaced apart by two lines and three spaces.

7. A musical staff as claimed in claim 6 wherein the notes applied between the sets of equally spaced lines forming the composite treble clef staff in ascending order are G, A, B, C and D.

8. A composite multiple bass clef and multiple treble clef musical staff as claimed in claim 1 having four sets of five equally spaced lines forming a composite of multiple treble clef staffs consisting of two sets of five equally spaced lines and of adjacent multiple bass clef staffs consisting of two sets of five equally spaced lines, the intermediate two sets, one bass and one treble, being spaced apart a distance equal to one line and three spaces of said spaced lines and the two outermost sets being spaced from the intermediate sets by two lines and three spaces.

* * * * *

UNITED STATES PATENT AND TRADEMARK OFFICE

CERTIFICATE OF CORRECTION

PATENT NO. : 4,277,090
DATED : July 7, 1981
INVENTOR(S) : DOMENICO F. LUSI

It is certified that error appears in the above-identified patent and that said Letters Patent are hereby corrected as shown below:

Column 2, line 38, "ball" should be --fall--.

Claim 2, column 4, line 30, "portion of the clef" should read --clef portion of the--.

Claim 2, column 4, line 31, "portion of the clef" should read --clef portion of the--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*